US006088855A

United States Patent [19]

Connolly

[11] Patent Number: 6,088,855

[45] Date of Patent: Jul. 18, 2000

[54] CERVICAL NECK SUPPORT FOR CHILDREN

[76] Inventor: Christopher Connolly, 19 Evans Grove Dr., Poquoson, Va. 23662

[21] Appl. No.: 09/361,384

[22] Filed: Jul. 26, 1999

Related U.S. Application Data

[60] Provisional application No. 60/094,157, Jul. 27, 1998.

[51] Int. Cl.[7] ..... A47C 20/02

[52] U.S. Cl. ..... 5/636; 5/655; 5/637; 297/397

[58] Field of Search ..... 297/397, 400; 128/869, 870; 5/636, 637, 643, 655

[56] References Cited

U.S. PATENT DOCUMENTS

| | | | |
|---|---|---|---|
| 4,285,081 | 8/1981 | Price | 5/637 |
| 4,750,478 | 6/1988 | Bergeron | 128/869 |
| 5,127,120 | 7/1992 | Mason | 5/637 X |
| 5,129,705 | 7/1992 | Wray | 297/397 |
| 5,146,641 | 9/1992 | Zwickey | 5/637 X |
| 5,154,477 | 10/1992 | Lacy | 297/397 |
| 5,339,472 | 8/1994 | Yin | 5/636 |

*Primary Examiner*—Michael F. Trettel

[57] ABSTRACT

A cervical neck support for children having a substantially rectangular shape and constructed of a semi-rigid molded foam material. A semi-circular recess is cut-out of a longitudinal side of the foam support for receiving the neck of a child when in a car-seat. The support insures a firm but comfortable hold to prevent jerky movement of the head of a child while riding in an automobile. It also maintains the natural curvature of a child's spine, and attaches to a car seat with use of fasteners. The fasteners are strips attached to the back of the support which detachably engages with the napped fabric of a car-seat for convenience. Second strips of adhesive fasteners are alternatively used for car-seat covers with plastic surfaces.

18 Claims, 4 Drawing Sheets

CERVICAL NECK SUPPORT FOR CHILDREN

This application claims benefit of Provisional Application 60/094,157 Jul. 27, 1998.

BACKGROUND OF THE INVENTION

1. Field of the Invention

The present invention relates generally to a neck support. More specifically, the invention is a cervical neck support for protecting the necks and spines of children while riding in a car or baby carrier.

2. Description of Related Art

Various neck supports have been devised for supporting the necks of adults and children. However, the problem is that most of these supports fail to provide the stability and needed structural support for protecting the neck and spinal cord of children; moreover, such braces should be simple to use and require minimal use of fasteners for attachment to the user. Another capability lacking with conventional neck supports is that they are not readily attachable to car seats or carrying carriages as disclosed herein.

For example, U.S. Pat. No. 4,550,458 issued to Fiore discloses a cervical support pillow with a semi-circular cut-out portion extending from the top edge to the central portion of the pillow for use by adults. The pillow involves complex positioning orientations about the head and neck. One position in particular is a sandwich type orientation about the head and neck, which if similarly used on children could cause suffocation.

U.S. Pat. No. 4,617,691 issued to Monti et al. discloses a wedge shaped pillow segment with fasteners for joining the neck support under the chin of a user. This method of attachment usually creates a certain level of discomfort for the user, and in the case of children, they are usually prone to remove the device. Another disadvantage of this type of support is that bodily and other fluids soiling the device makes removing it distasteful. The instant invention, however, does not suffer these particular problems.

U.S. Pat. No. 5,257,429 issued to Genis discloses a therapeutic head and neck-rest which is filled with a liquid at a suitable temperature. The structure and intended purpose of this therapeutic rest pillow is completely different and teaches away from the instant invention.

U.S. Pat. No. 5,339,472 issued to Yin discloses a infant head and neck support pillow in a flat rectangular shape. The structure of the pillow is not as robust as that of the instant invention, and can be quite cumbersome since it is not capable of being fastened directly to a car seat or similar apparatus.

U.S. Pat. No. 5,586,351 issued to Ive discloses an infant support pad with an adjustable pillow which provides lateral stability of the infant's head and neck. The pad can be adjusted to adapt to an increase in the infants size. The problem with this device, however is that if the infant is inappropriately placed in the bay carriage when the head support is secured, one risks reinforcing an otherwise inappropriate head and neck position. This type of mistake is common with the use of infant support pads.

U.S. Pat. No. 5,588,445 issued to Obaidi discloses a head and neck protector for children which includes a flexible planar back member with mid and lower torso straps for securing the user. There is no disclosure for a structural support for the head and neck as taught by the invention herein described.

The cervical neck support of the instant invention is different from the prior and related art, in that it provides sturdy and comfortable head and neck support for children, with the capability of being readily attachable to car seats or similar devices without cumbersome attachments, due to the unnecessary use of fasteners. Thus, none of the above inventions and patents, taken either singly or in combination, is seen to describe the instant invention as claimed.

SUMMARY OF THE INVENTION

The cervical neck support according to the invention has a substantially rectangular configuration and is constructed of a semi-rigid foam material. A semi-circle is centrally cut-out of the long or longitudinal side of the foam support to provide an ergonomic design for receiving the neck of a child when attached to a car seat. The support provides a firm, but comfortable hold to prevent jerky movement while riding in a car or similar vehicle. It is also valuable for maintaining the natural curvature of the child's spine. The support is conveniently affixed with first fasteners, such as hook tape of a hook and loop type fastener, for firm attachment to the napped fabric of a car-seat. Second adhesive fasteners, such as double sided tape, detachably engages the support to car-seat surfaces made of plastic. The fasteners are convertibly arranged on the rear or back planar surface of the neck support in a manner which allows use of one or the other fastener at a time.

Accordingly, it is a principal object of the invention to provide a cervical neck support which stabilizes the head of a child.

It is another object of the invention to provide a cervical neck support which maintains the natural lordotic curve of a child's cervical spine.

It is a further object of the invention to provide a neck support which is attachable to any car seat or similar device until it is removed for height or comfort adjustments and cleaning.

Another object of the invention is to provide a cervical neck support made of semi-rigid molded foam material.

Still another object of the invention is to provide a cervical neck support having a cover which is machine washable and flame retardant.

Also, it is an object of the invention to provide improved elements and arrangements thereof in the cervical neck support for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a cervical neck support for children. The preferred embodiments of the present invention are depicted in FIGS. 1–4, and is generally referenced by numeral 5.

Figure 1:
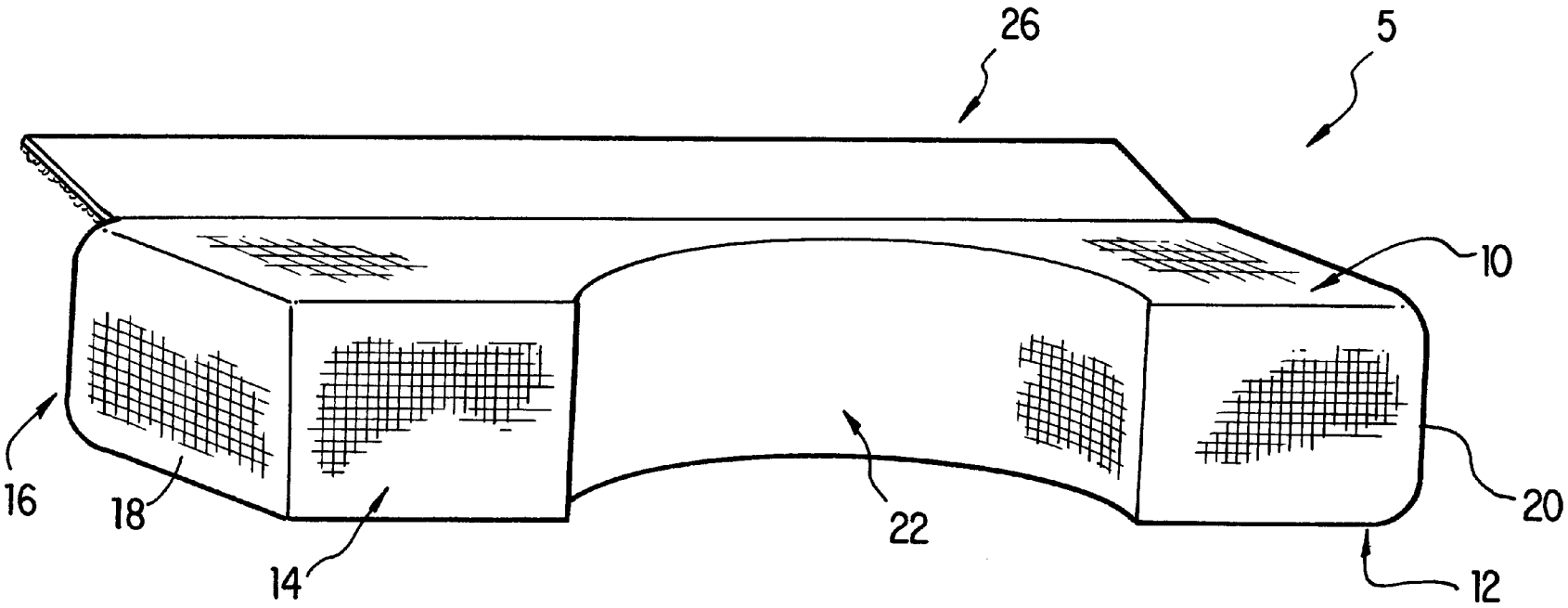
FIG. 1 is a perspective view of the cervical neck support according to the invention.
Figure 2:
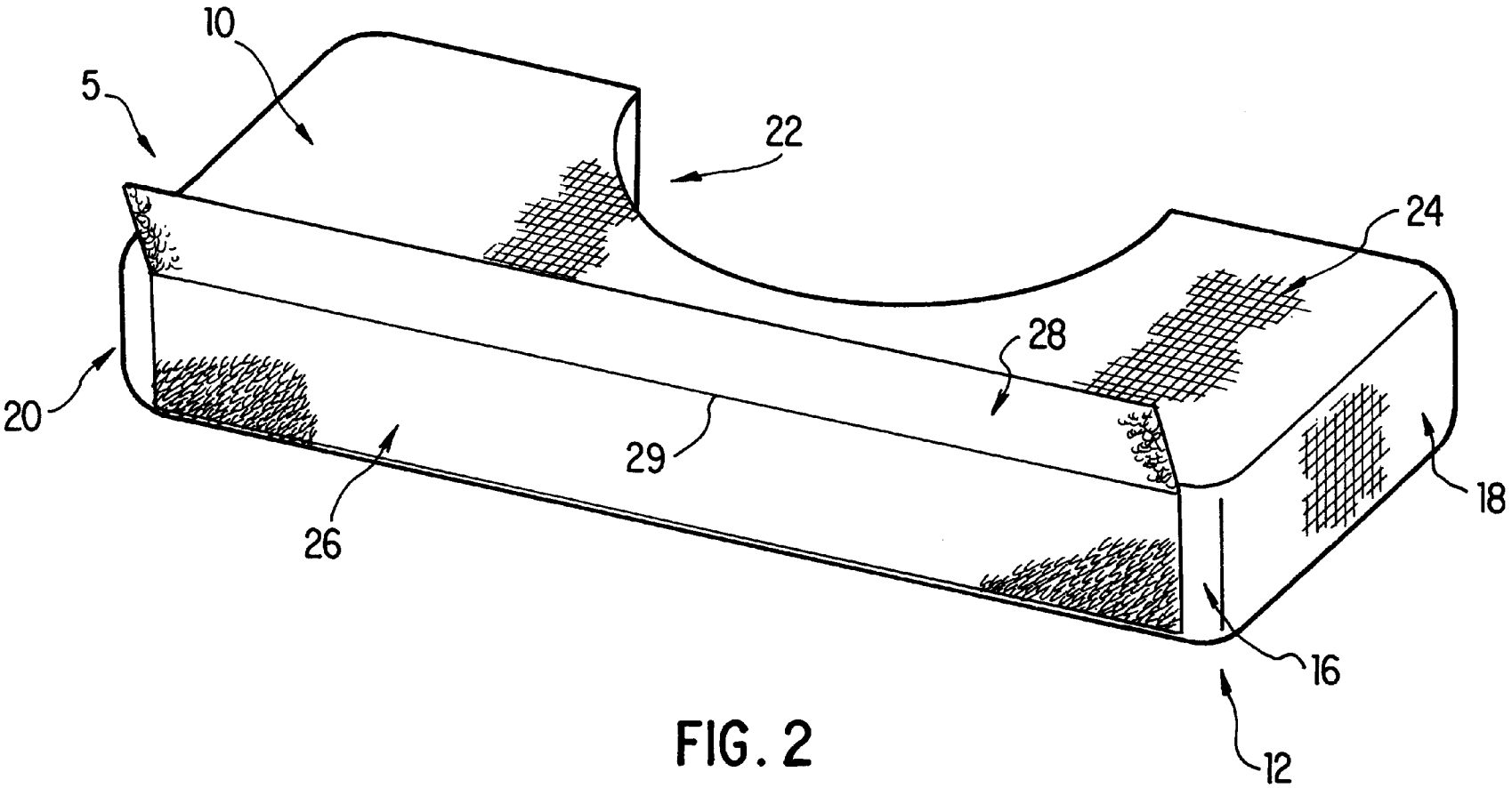
FIG. 2 is a rear view of the cervical neck support according to the invention, illustrating the convertible relationship of the hook and loop components of a fastener to expose the hook component for attachment to a napped surface.

As best seen in FIGS. 1 and 2, the cervical neck support for children comprises the support 5 having a substantially rectangular shape with a top 10, bottom 12, front 14, back 16 and first 18 and second 20 planar side portions. The support further comprises a semi-circular recess 22 centrally cut within the front planar side portion 14 of a long or longitudinal side of the support for receiving a neck of a user.

A cover 24 snugly fits over the foam support, and is removable for washing or replacement. Replacement covers may include alternative surface design (e.g., cartoon characters, super heroes etc.). The method of securing and removing the cover can be via zipper mechanisms or via fabric cuffing. These types of methods are well known to one of ordinary skill in the art and are not shown. The shape of the support can include other shapes having longitudinal sides such as a substantially elliptical shape with planar sides similar to the first and second sides (18 and 20, respectively) as in the preferred embodiment.

A fastener 26 is provided for attaching to the surface of car-seats, or, to similar carriers for children having different surface types. Numerous fasteners are available to the skilled artisan for attaching neck supports to a different array of carriers for children. In most conventional neck supports, fasteners such as buttons of varying sorts, slip and buckle straps, etc. are used to secure these supports to a user or alternatively to a carrier.

The fastener 26 for the preferred embodiment is a hook and loop fastener for attaching the hook component to the napped fabric of a seat or carrier surface. These type of fasteners are well known in relevant art as removable fasteners and are available to the skilled artisan under the name VELCRO™. These type of fasteners can be separately or integrally attached to the cover 24 via stitching or adhesive methods. Such means of attachment are well within the knowledge of the skilled artisan and requires only routine skill in the art to provide.

To permit different fasteners to be convertibly used with different surfaces, the preferred embodiment, as shown in FIG. 2, includes a fastener 26 which is a foldable hook and loop flap 28. The foldable flap 28 comprises a top portion and a bottom portion, each portion being a different component of the hook and loop tape fastener, the hooks and loops facing in the same direction when the components are lying in the same plane, and hinged such that the components can be folded about a line 29 so that the hooks and the loops may be brought into engagement wherein the hooks and loops face each other (i.e. opposing one another). The hinge line 29 can be created by stitching two hook and loop tapes together along contiguous sides, in the above described relationship.

The bottom portion of the flap, notably the hook portion, is adhesively attached to the back planar side portion 16 of the support 5, along the length or longitudinal side of said support, opposite and parallel to the front planar side portion 14. There is no particular preference regarding which portion of the flap is secured to the back planar side portion 16 of the support 5, so long as it provides the intended purposes as herein described. Regardless of the portion attached to the support 5, when the loop portion of the foldable flap 28 is not engaging the hook portion, i.e, the flap being in an open state as shown in FIG. 2, the hook portion is therefore exposed for attachment to a napped surface. Although the loop surface is also exposed, it serves no operational purpose in an open state.

Figure 4:
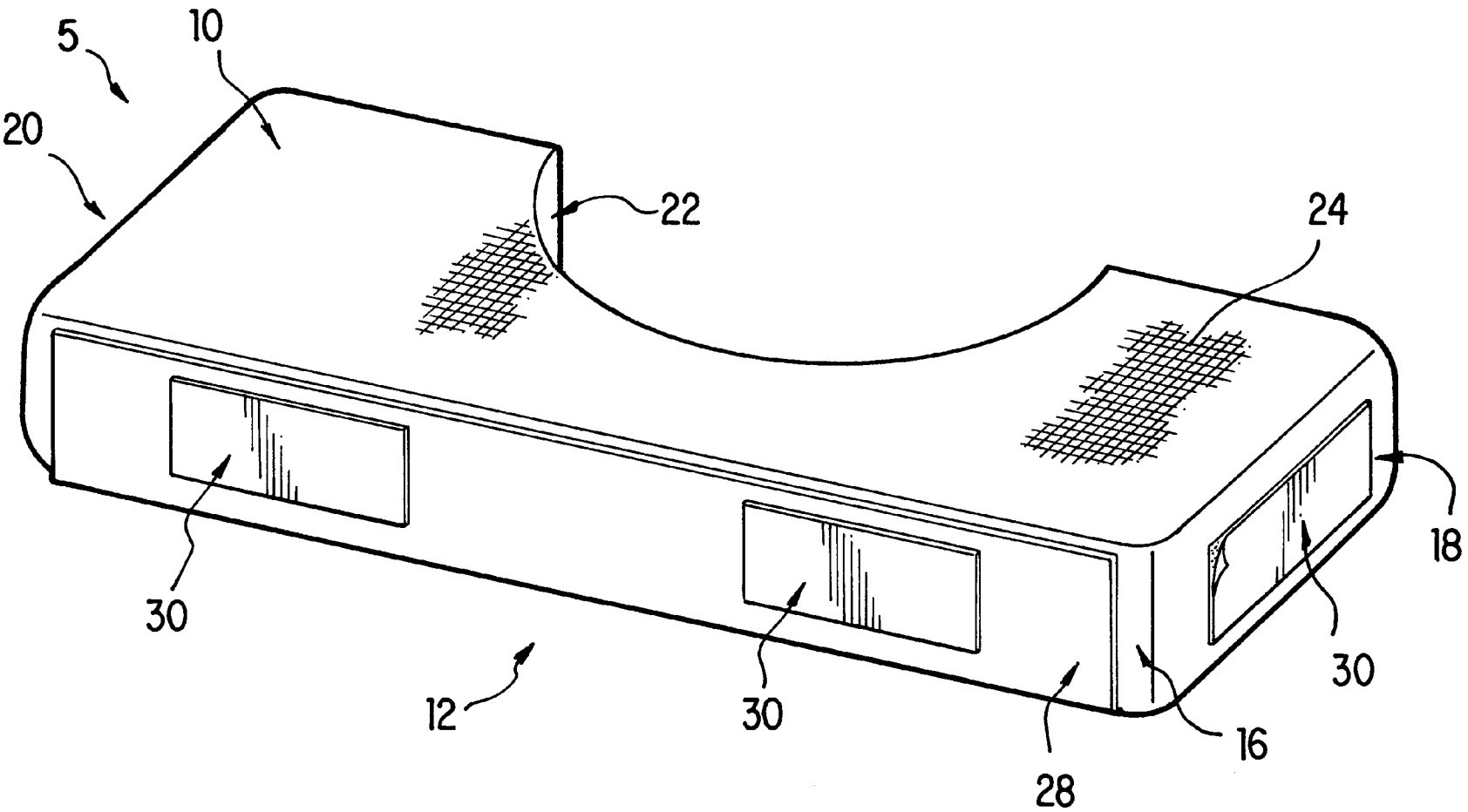
FIG. 4 is a perspective view of the neck support according to the invention including adhesive second fasteners for attachment to plastic surfaces.

However, when the loop portion of the foldable flap 28 is folded onto and opposing the hook portion, it defines a closed state, and thus is releasably attached to the adhesively secured hook portion for ready conversion back to the open state. Thus, in such a closed state, as shown in FIG. 4, the hooks and loops are hidden, exposing a backside surface of the flap 28, namely, the back side of the loop tape. As shown in FIG. 4, this surface is provided with second fasteners 30 thereon.

Hence, by converting the flap from an open to a closed state, the second fasteners 30 can be selectively chosen for use with an alternative surface. The external surface can be plastic, vinyl or similar surfaces for attachment to the support of the preferred embodiment.

In some instances, there is a need to provide an additional level of stability to the support 5, for example, due to varying designs of car-seats. To insure the extra level of stability when in use, for this or other purposes, the cervical neck support according to the invention includes additional fasteners. These may be a different set of hook and loop strips, adhesively backed for attachment to opposing surfaces, or, preferably, simple double-sided adhesive strips 30. The fasteners are permanently or temporarily secured, as shown in FIG. 4, to the first and second planar side portions for attachment to abutting surfaces, such as the side of the car-seat shown as a cut-away section in FIG. 3. Also, this added stability is important for attachment to plastic surfaces, since per area unit, a hook fastener has greater adhesion strength with a loop surface, than most double-sided adhesive tapes do with plastic.

Figure 3:
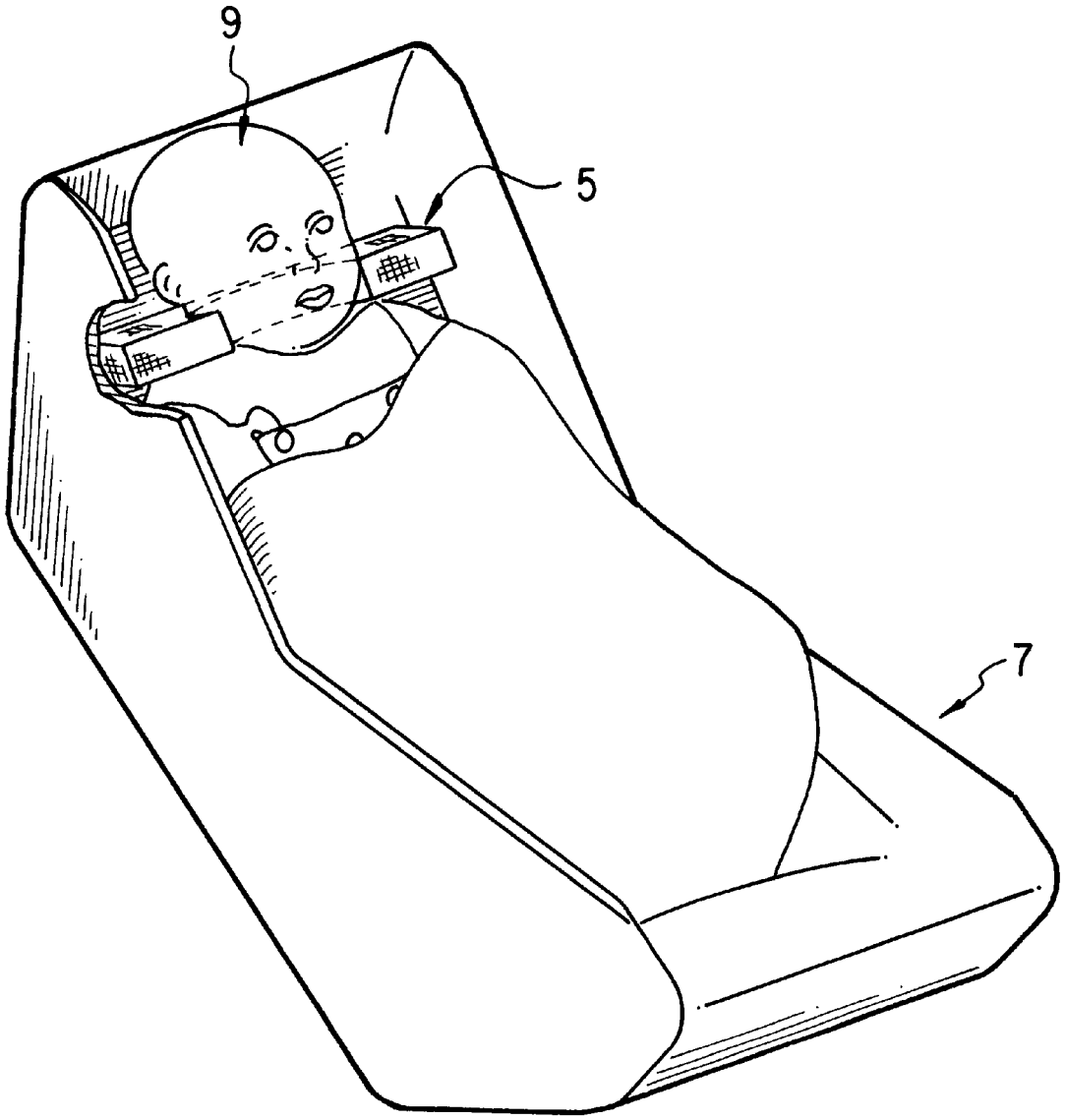
FIG. 3 is an environmental view of the neck support according to the invention in combination with a car-seat and child.

Another embodiment of the invention is diagrammatically illustrated in FIG. 3 as alluded to above. As shown therein is the cervical neck support 5 of the instant invention in combination with a car-seat 7. The neck support 5 is strategically arranged to provide the level of structural support and comfort for a child 9, in order to maintain the natural lordotic curve of the cervical spine. In the event the surface cover of the car-seat is made of material other than a material similar to vinyl fabric, such as plastic, FIG. 4 provides an alternative illustration of the use of double-sided adhesive fasteners 30 for special attachment situations.

The attachments are not only included on the first 18 and second 20 planar side portions as recited above, but include the fasteners 30 attached to the back portion of the support 5 as well. This type of arrangement of the fasteners 30 can be made by attaching them to the back planar side portion 16 with the foldable hook and loop flap 28 removed (not shown) or by applying them to the top surface of the closed foldable flap 28.

Other advantages of the instant invention include the cover being made of a removable cloth or vinyl fabric which is washable and flame retardant, and can include numerous cover designs as recited above. Notwithstanding, the cervical neck support 5 according to the invention is made of a semi-rigid molded foam material. Many other materials can be used so long as the materials provide the structural stability and level of comfort as intended in the instant invention.

It is to be understood that the present invention is not limited to the sole embodiment described above, but encompasses any and all embodiments within the scope of the following claims.

I claim:

1. A cervical neck support for children comprising: a support having a substantially rectangular shape with a top, bottom, front, back and first and second planar side portions, said support defining a semi-circular recess centrally cut within the front planar side portion for receiving a neck of a user; a cover for enclosing said support; and a fastener attached to said back planar side portion for attaching said support to a surface, wherein said fastener is a foldable flap having both hook fastener and loop fastener on a single surface.

2. The cervical neck support according to claim 1, wherein the support is made of a semi-rigid molded foam material.

3. The cervical neck support according to claim 1, wherein said fastener is a hook and loop fastener, each component thereof having an adhesive backing.

4. The cervical neck support according to claim 1, wherein the foldable flap is adhesively attached to the back planar side portion of the support along the length of said back planar side portion, being opposite and parallel to the front planar side portion.

5. The cervical neck support according to claim 4, wherein the loop fastener of the foldable flap has a backside, said loop fastener is removably folded upon the adhesively attached hook fastener of said flap, said backside having a second adhesive tape for attachment to vinyl surfaces.

6. The cervical neck support according to claim 4, wherein the loop fastener of the foldable flap has a backside, said loop fastener is removably folded upon the adhesively attached hook fastener of said flap, said backside having a second adhesive tape for attachment to cloth surfaces.

7. The cervical neck support according to claim 3, wherein the hook and loop fastener is adhesively attached to said first and second planar side portions.

8. The cervical neck support according to claim 1, wherein the cover is made of a removable cloth or vinyl fabric.

9. The cervical neck support according to claim 8, wherein the cloth or vinyl fabric is flame retardant.

10. A cervical neck support car seat for children comprising: a car-seat in combination with a neck support having a substantially rectangular shape with a top, bottom, front, back and first and second planar side portions, said support defining a semi-circular recess centrally cut within a front portion of the support for receiving a neck of a user, a cover, and a fastener for attachment to the car seat, wherein said fastener is a foldable flap having both hook fastener and loop fastener on a single surface.

11. The cervical neck support car-seat according to claim 10, wherein the support is made of a semi-rigid molded foam material.

12. The cervical neck support according to claim 10, wherein said fastener is a hook and loop fastener, each component thereof having an adhesive backing.

13. The cervical neck support according to claim 10, wherein the foldable flap is adhesively attached to the back planar side portion of the support along the length of said back planar side portion, being opposite and parallel to the front planar side portion.

14. The cervical neck support according to claim 10, wherein the loop fastener of the foldable flap has a backside, said loop fastener is removably folded upon the adhesively attached hook fastener of said flap, said backside having a second adhesive tape for attachment to vinyl surfaces.

15. The cervical neck support according to claim 10, further including a hook and loop fastener adhesively attached to said first and second planar side portions.

16. The cervical neck support according to claim 10, wherein the cover is made of a flame retardant fabric.

17. The cervical neck support according to claim 16, wherein the flame retardant fabric is a removable vinyl fabric.

18. The cervical neck support according to claim 16, wherein the flame retardant fabric is a removable cloth fabric.

* * * * *